US007796931B2

(12) United States Patent
Yasuda et al.

(10) Patent No.: US 7,796,931 B2
(45) Date of Patent: Sep. 14, 2010

(54) HEATING APPARATUS INCLUDING ELECTRICALLY CONDUCTIVE HEAT PRODUCING LAYER PROVIDING SHORT HEAT INCREASE TIME AND TEMPERATURE UNIFORMITY

(75) Inventors: Akihiro Yasuda, Osaka (JP); Noboru Katakabe, Kyoto (JP); Masahiro Samei, Osaka (JP)

(73) Assignee: Panasonic Corporation, Osaka (JP)

( * ) Notice: Subject to any disclaimer, the term of this patent is extended or adjusted under 35 U.S.C. 154(b) by 508 days.

(21) Appl. No.: 11/720,985

(22) PCT Filed: Dec. 6, 2005

(86) PCT No.: PCT/JP2005/022352

§ 371 (c)(1),
(2), (4) Date: Jun. 6, 2007

(87) PCT Pub. No.: WO2006/062086

PCT Pub. Date: Jun. 15, 2006

(65) Prior Publication Data

US 2009/0232565 A1 Sep. 17, 2009

(30) Foreign Application Priority Data

Dec. 7, 2004 (JP) ..... 2004-354445

(51) Int. Cl.
*G03G 15/20* (2006.01)

(52) U.S. Cl. ..... 399/328

(58) Field of Classification Search ..... 399/328, 399/333, 320; 219/216

See application file for complete search history.

(56) References Cited

U.S. PATENT DOCUMENTS

| | | | | |
|---|---|---|---|---|
| 6,069,347 | A | 5/2000 | Genji et al. | |
| 6,625,417 | B1 | 9/2003 | Terada et al. | |
| 7,006,781 | B2 * | 2/2006 | Imai et al. | 399/333 |
| 2004/0105708 | A1 | 6/2004 | Imai et al. | |
| 2004/0136762 | A1 | 7/2004 | Okayasu et al. | |

(Continued)

FOREIGN PATENT DOCUMENTS

| | | |
|---|---|---|
| JP | 830126 | 2/1996 |

(Continued)

OTHER PUBLICATIONS

Computer translations: JP2001-176648A JP08-030126A.*

(Continued)

*Primary Examiner*—Quana M Grainger
(74) *Attorney, Agent, or Firm*—Greenblum & Bernstein P.L.C.

(57) ABSTRACT

A heating apparatus which can increase the temperature of a heating element to a target temperature in a short time and ensures temperature uniformity of the heating element. In the heating apparatus, when the specific resistance of a material of a heat generating layer of a heating roller is ρ (μ'Ωcm), the average thickness of the heat generating layer is 5ρ (μm) or more but not more than 15ρ (μm), and the thickness error is 1.2ρ (μm) or less. For instance, when the heat generating layer is copper having a specific resistance of 1.7 (μ'Ωcm), the average thickness of the heat generating layer is 8-25 (μm), and the thickness error is 2 (μm) or less. Thus, the heating roller having a short heat increasing time and excellent temperature uniformity is provided.

25 Claims, 7 Drawing Sheets

U.S. PATENT DOCUMENTS

2005/0286938 A1 * 12/2005 Aze et al. ..... 399/328

FOREIGN PATENT DOCUMENTS

| | | | |
|---|---|---|---|
| JP | 10208859 | | 8/1998 |
| JP | 2001176648 | | 6/2001 |
| JP | 2001176648 | A * | 6/2001 |
| JP | 2001188427 | | 6/2001 |
| JP | 2002260836 | | 9/2002 |
| JP | 2003215958 | | 7/2003 |
| JP | 2004133370 | | 4/2004 |
| JP | 2004145368 | | 5/2004 |
| JP | 2004226822 | | 8/2004 |
| JP | 2004341164 | | 12/2004 |
| WO | 2003043379 | | 5/2003 |
| WO | 2004061531 | | 7/2004 |

OTHER PUBLICATIONS

English language abstract of JP 2004-145368.

* cited by examiner

HEATING APPARATUS INCLUDING ELECTRICALLY CONDUCTIVE HEAT PRODUCING LAYER PROVIDING SHORT HEAT INCREASE TIME AND TEMPERATURE UNIFORMITY

TECHNICAL FIELD

The present invention relates to a heating apparatus that heats a heated element using a heat-producing element that is heated by means of induction heating (IH), and more particularly to a heating apparatus that is suitable for use as a heating section of a fixing apparatus in an image forming apparatus such as an electrophotographic or electrostatographic copier, facsimile machine, or printer.

BACKGROUND ART

While an induction heating type of heating apparatus is generally known as a heating section of a hot plate, electric oven, or the like, investigations have in recent years been actively pursued into the use of an induction heating type of heating apparatus as a heating section in an image forming apparatus such as a copier, facsimile machine, or printer.

In a fixing apparatus that uses an induction heating type of heating section, magnetic flux generated by a magnetic flux generation section is made to permeate a heat-producing layer of a heat-producing element, and the heat-producing layer is made to produce heat by means of an eddy current generated by the permeation of this magnetic flux. Then an unfixed image formed on recording paper such as copy paper or an OHP sheet is directly or indirectly heat-fixed by heat of the heat-producing element heated by heat production of this heat-producing layer.

Specifically, for example, a heat-producing layer of electrically conductive material is formed on a heat-producing element comprising a fixing roller, fixing belt, or the like. Also, the heat-producing element and a pressure roller on either side of the recording paper feed path are positioned so as to be pressed together, forming a nip that grips and transports recording paper. Furthermore, an exciting coil is wound around a core of ferromagnetic material, forming a magnetic flux generation section, and the exciting coil is positioned opposite the heat-producing layer of the heat-producing element. Then an alternating current of predetermined frequency is applied to the exciting coil, and magnetic flux is generated around the exciting coil, forming a magnetic field, and the heat-producing layer of the heat-producing element is made to produce heat by means of an eddy current generated by the action of this magnetic field. In this state, recording paper is transported to the nip between the heat-producing element and pressure roller, and an unfixed image on the recording paper is fixed by heat of the heat-producing element heated by heat production of the heat-producing layer and pressure of the pressure roller.

An advantage of a fixing apparatus that uses this induction heating type of heating section, compared with a heat roller type of fixing apparatus that uses a halogen lamp as a heat source, is that heat production efficiency is higher and the time required for heating to a predetermined temperature can be shortened.

In an induction heating type of heating apparatus, as described above, when an alternating current flows in the exciting coil, a magnetic field is generated and magnetic flux penetrates the heat-producing layer. As a result, an eddy current I is generated in the heat-producing layer by electromagnetic induction, and heat $RI^2$ proportional to resistance R of the heat-producing layer is generated.

Therefore, with this kind of heating apparatus, when the exciting coil is positioned opposite the heat-producing element, the larger the value of exciting coil resistance R, the higher is the heat production efficiency of the heat-producing layer.

This exciting coil resistance value R is known to be highest when the thickness of copper serving as the heat-producing layer is 5 (μm). Therefore, with this kind of induction heating type of heating apparatus, the heat production efficiency of the heat-producing layer is optimal when a heat-producing element is used in which the thickness of copper serving as the heat-producing layer is 5 (μm).

A known conventional fixing apparatus configured with attention paid to this kind of relationship between the thickness of the heat-producing layer and heat production efficiency is a fixing apparatus that uses an electrically conductive layer with a thickness of approximately 5 (μm) as the heat-producing layer (copper) of the heat-producing element (heating belt) (see Patent Document 1, for example). In the fixing apparatus described in Patent Document 1, a heating belt on which an electrically conductive layer is formed by vapor deposition of highly electrically conductive copper to an extremely small thickness of approximately 5 (μm) on a polyimide base material is used as the heat-producing element.

Patent Document 1: Unexamined Japanese Patent Publication No. 2004-145368

DISCLOSURE OF INVENTION

Problems to be Solved by the Invention

In the above conventional induction heating type of heating apparatus, attention has been paid only to the resistance value (heat production efficiency) of the heat-producing layer with regard to optimization of the thickness of the heat-producing layer (copper) of the heat-producing element.

However, an induction heating type of heating apparatus has a property such that, as the thickness of the heat-producing layer (copper) decreases, the inductance of the exciting coil increases, it becomes more difficult for a current to flow in the heat-producing layer, and electromagnetic coupling is reduced.

Thus, the present inventors also paid attention to the inductance (electromagnetic coupling) of the exciting coil, and tried various experiments. As a result, it was found that, in this kind of induction heating type of heating apparatus, if both the resistance value (heat production efficiency) of the heat-producing layer of the heat-producing element and the inductance (electromagnetic coupling) of the exciting coil are taken into consideration, making the thickness of the heat-producing layer 5 (μm) is not necessarily optimal (as explained in detail later herein).

For example, with a conventional fixing apparatus that uses a fixing belt (heat-producing element) with an extremely thin heat-producing layer (electrically conductive layer), it became clear that nonuniformity of heat production tended to occur in the heating belt due to variations in the thickness of the heat-producing layer, and the temperature of the heating belt became uneven. It also became clear that a heat-producing element on which a heat-producing layer thicker than a conventional heat-producing layer is formed enables the temperature rise time required to raise the temperature of the heat-producing element to a target temperature to be shortened.

It is an object of the present invention to provide a heating apparatus that enables the temperature rise time until the temperature of a heat-producing element is raised to a target temperature to be shortened, and uniformity of the temperature of the heat-producing element to be ensured.

Means for Solving the Problems

A heating apparatus of the present invention employs a configuration that includes a magnetic flux generation section that generates magnetic flux, and a heat-producing element having an electrically conductive heat-producing layer that is induction-heated by magnetic flux generated by the magnetic flux generation section, wherein, when the specific resistance of the material of the heat-producing layer is designated ρ (μ'Ωcm), the heat-producing layer has an area in which the average thickness is greater than or equal to 5ρ (μm) and less than or equal to 15ρ (μm), and the thickness error is less than or equal to 1.2ρ (μm).

ADVANTAGEOUS EFFECT OF THE INVENTION

The present invention enables the temperature rise time until the temperature of a heat-producing element is raised to a target temperature to be shortened, and uniformity of the temperature of the heat-producing element to be ensured.

BEST MODE FOR CARRYING OUT THE INVENTION

Embodiments of the present invention will now be described in detail with reference to the accompanying drawings. Here, fixing apparatuses in image forming apparatuses are described as embodiments of the present invention, but it goes without saying that a heating apparatus of the present invention is also useful as a heating section of a hot plate, electric oven, or the like.

Embodiment 1

Figure 1:
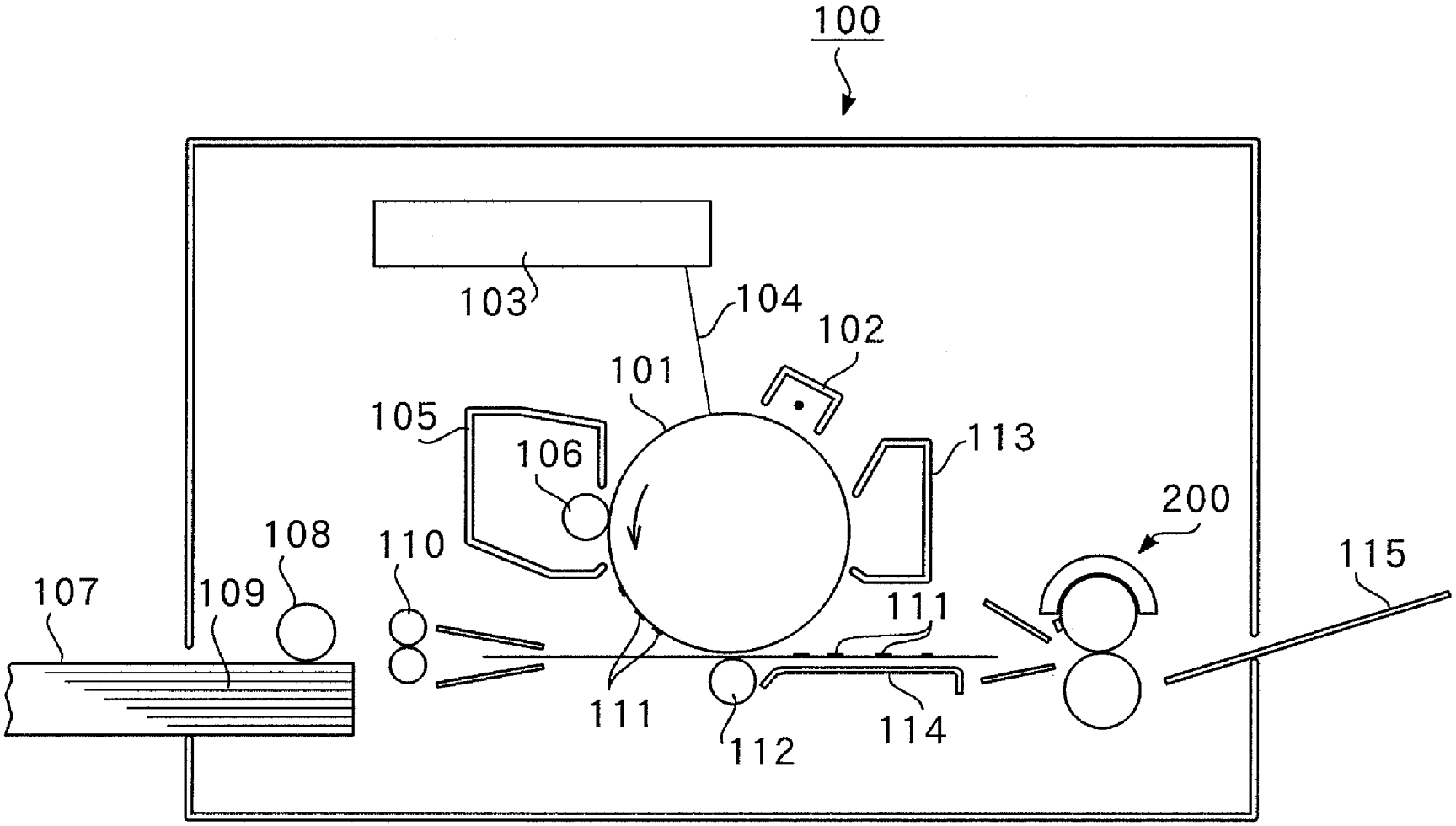
FIG. 1 is a schematic cross-sectional drawing showing the overall configuration of an image forming apparatus suitable for incorporation of a fixing apparatus according to Embodiment 1 of the present invention.

FIG. 1 is a schematic cross-sectional drawing showing the overall configuration of an image forming apparatus suitable for incorporation of a fixing apparatus according to Embodiment 1 of the present invention.

As shown in FIG. 1, an image forming apparatus 100 has an electrophotographic photosensitive body (hereinafter referred to as "photosensitive drum") 101, an electrifier 102, a laser beam scanner 103, a developing unit 105, a paper feed apparatus 107, a cleaning apparatus 113, a fixing apparatus 200, and so forth.

In FIG. 1, photosensitive drum 101 is rotated at a predetermined peripheral velocity in the direction indicated by the arrow while its surface is uniformly charged to a negative predetermined dark potential by electrifier 102.

Laser beam scanner 103 outputs a laser beam 104 modulated in accordance with a time series electrical digital pixel signal of image information input from a host apparatus such as an image reading apparatus or computer (not shown), and performs scanning exposure of the surface of uniformly charged photosensitive drum 101 with laser beam 104. By this means, the absolute value of the potential of exposed parts of photosensitive drum 101 falls and becomes a light potential, and an electrostatic latent image is formed on the surface of photosensitive drum 101.

Developing unit 105 is provided with a rotated developing roller 106. Developing roller 106 is positioned opposite photosensitive drum 101, and a thin layer of toner is formed on its outer peripheral surface. A developing bias voltage with an absolute value smaller than the dark potential of photosensitive drum 101 and larger than the light potential is applied to developing roller 106.

By this means, negatively charged toner on developing roller 106 adheres only to light potential parts of the surface of photosensitive drum 101, the electrostatic latent image formed on the surface of photo sensitive drum 101 is developed, and an unfixed toner image 111 is formed on photosensitive drum 101.

Meanwhile, paper feed apparatus 107 feeds recording paper 109 as a recording medium one sheet at a time at predetermined timing by means of a paper feed roller 108. Recording paper 109 fed from paper feed apparatus 107 is transported through a pair of registration rollers 110 to the nip area between photosensitive drum 101 and a transfer roller 112 at appropriate timing synchronized with the rotation of photosensitive drum 101. By this means, unfixed toner image 111 on photosensitive drum 101 is transferred to recording paper 109 by transfer roller 112 to which a transfer bias is applied.

Recording paper 109 to which unfixed toner image 111 has been transferred in this way is guided by a recording paper guide 114 and separated from photosensitive drum 101, and then transported toward fixing apparatus 200 where unfixed toner image 111 is heat-fixed.

After passing through fixing apparatus 200, recording paper 109 onto which unfixed toner image 111 has been heat-fixed is ejected onto an output tray 115 attached to the outside of image forming apparatus 100.

After recording paper 109 has been separated from photosensitive drum 101, photosensitive drum 101 has residual material such as untransferred toner remaining on its surface removed by a cleaning apparatus 113, and is made ready for the next image forming operation.

Figure 2:
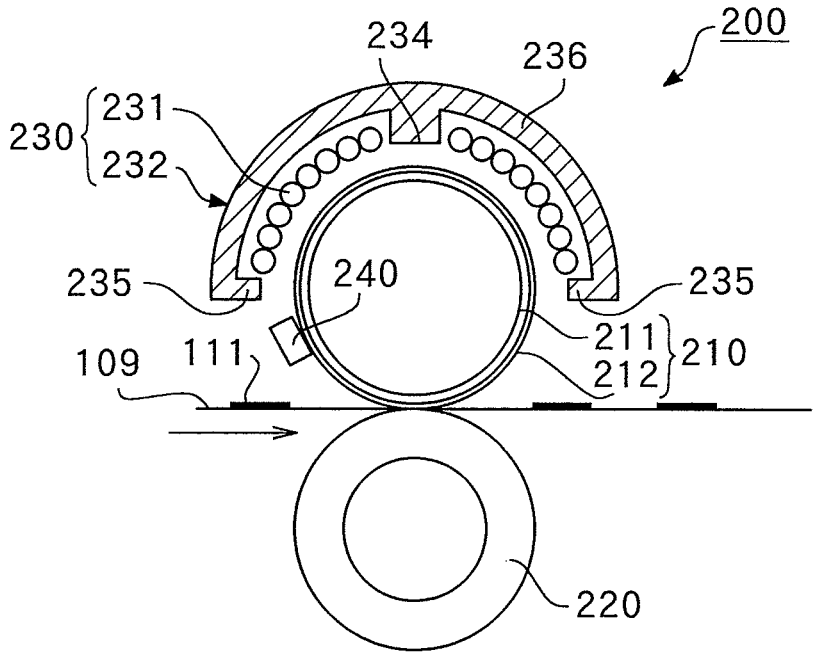
FIG. 2 is a schematic cross-sectional drawing showing the configuration of the principal parts of a fixing apparatus according to Embodiment 1 of the present invention.

FIG. 2 is a schematic cross-sectional drawing showing the configuration of the principal parts of a fixing apparatus according to Embodiment 1 of the present invention. As shown in FIG. 2, fixing apparatus 200 according to Embodiment 1 has a heat-producing roller 210 as a heat-producing element, a pressure roller 220, an exciting coil unit 230 as a magnetic flux generation section, a temperature sensor 240, and so forth.

In FIG. 2, heat-producing roller 210 is configured by forming a heat-producing layer 212 comprising an electrically conductive layer on the outer peripheral surface of a cylindrical roller member 211 with a diameter of 34 (mm), for example, and is pivoted in a freely rotatable fashion in a body side plate (not shown) of fixing apparatus 200.

Pressure roller 220 is pivoted in a freely rotatable fashion in a body side plate of fixing apparatus 200 so as to press against heat-producing roller 210 on the other side of the recording paper 109 feed path, and form a nip through which recording paper 109 passes. Pressure roller 220 rotates (clockwise in the figure) so that recording paper 109 on which unfixed toner image 111 is formed and held is transported in the direction indicated by the arrow. Here, heat-producing roller 210 is rotated in idler fashion by the rotation of pressure roller 22, but alternatively, pressure roller 220 may be rotated in idler fashion by the rotation of heat-producing roller 210.

Pressure roller 220 is formed from a material of low thermal conductivity such as silicone rubber with a hardness of JISA 30 degrees, for example. A heat-resistant resin or other rubber such as fluororubber or fluororesin may also be used as the material of pressure roller 220. It is also desirable for the outer peripheral surface of pressure roller 220 to be coated with resin or rubber such as PTFE, PFA, or FEP, alone or mixed, to increase wear resistance and releasability.

Exciting coil unit 230 has an exciting coil 231 and a core member 232. Exciting coil 231 is formed using litz wire comprising bundled thin wires, for example, wound in a semicircular shape so as to be opposite the outer peripheral surface of the upper half of heat-producing roller 210, and forms a surrounding magnetic field by generating magnetic flux through the flow of an alternating current when a voltage is applied from a power supply (not shown).

Core member 232 is formed from a magnetic material of high permeability and resistivity such as ferrite or permalloy, and is composed of a center core 234, a pair of side cores 235, and an arch core 236.

Center core 234 is positioned (or integrally formed) in the center of arch core 236. The pair of side cores 235 are positioned (or integrally formed) at either end of arch core 236. Core member 232 forms a path (magnetic path) for magnetic flux generated on the side opposite heat-producing roller 210 of the magnetic flux generated by exciting coil 231.

As described above, in fixing apparatus 200 according to Embodiment 1, exciting coil unit 230 is located outside heat-producing roller 210, enabling maintenance work and replacement of parts such as heat-producing roller 210, which is a consumable, to be carried out efficiently.

Temperature sensor 240 is positioned so as to be in contact with the outer peripheral surface of heat-producing roller 210 downstream of exciting coil unit 230 in the direction of rotation, and detects the temperature of heat-producing roller 210. When the temperature of heat-producing roller 210 is detected by temperature sensor 240 to have reached a temperature suitable for fixing unfixed toner image 111, the start of operation of paper feed roller 108—that is, the start of a print operation—by a control section (not shown) becomes possible.

When the temperature of heat-producing roller 210 is detected by temperature sensor 240 to have become higher than a predetermined threshold value, the alternating current supply from the power supply (not shown) to exciting coil unit 230 is controlled.

Figure 3:
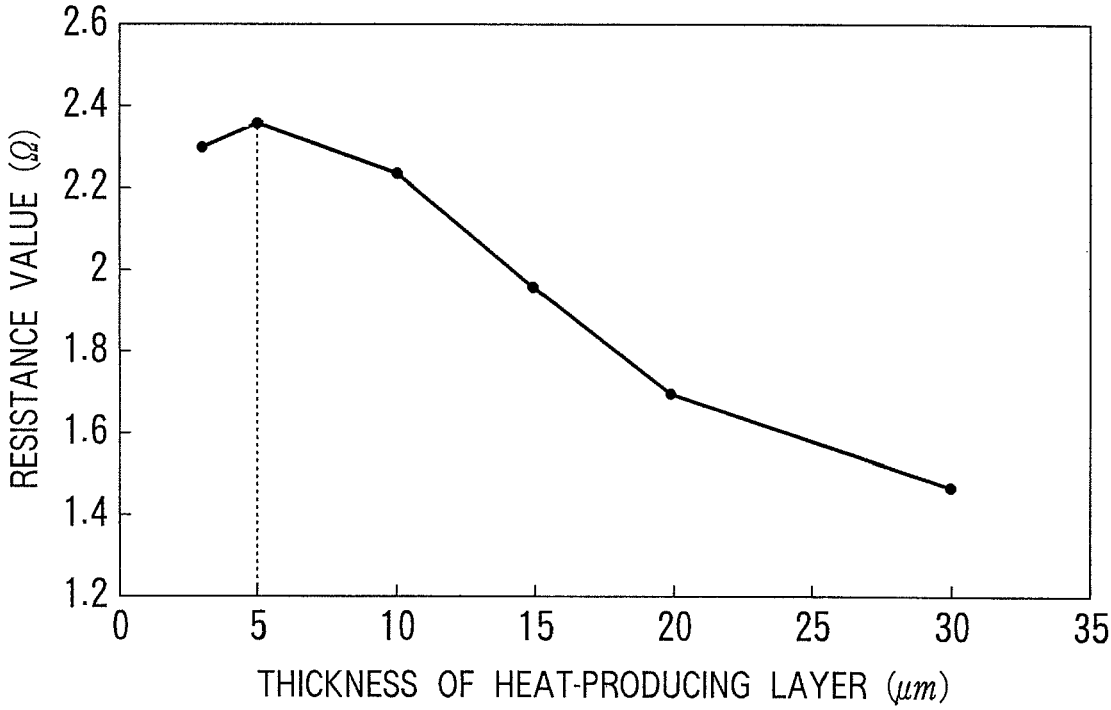
FIG. 3 is a graph in which the resistance value of an exciting coil when an alternating current of 30 (kHz) frequency is applied to the exciting coil is plotted against the thickness of the heat-producing layer (copper) of a heat-producing roller.

Next, the configuration of heat-producing roller 210 of fixing apparatus 200 according to Embodiment 1 will be described. FIG. 3 is a graph in which the resistance value of an exciting coil when an alternating current of 30 (kHz) frequency is applied to the exciting coil is plotted against the thickness of the heat-producing layer (copper) of a heat-producing roller.

As shown in FIG. 3, the resistance value of exciting coil 231 is highest, at approximately 2.4 ('Ω), when the thickness of heat-producing layer 212 of heat-producing roller 210 is 5 (μm). This shows that the heat production efficiency of heat-producing layer 212 is optimal when a heat-producing roller 210 in which the thickness of heat-producing layer 212 is 5 (μm) is used. Accordingly, the thickness of the heat-producing layer of the heat-producing element is made approximately 5 (μm) in a conventional induction heating type of fixing apparatus.

Figure 4:
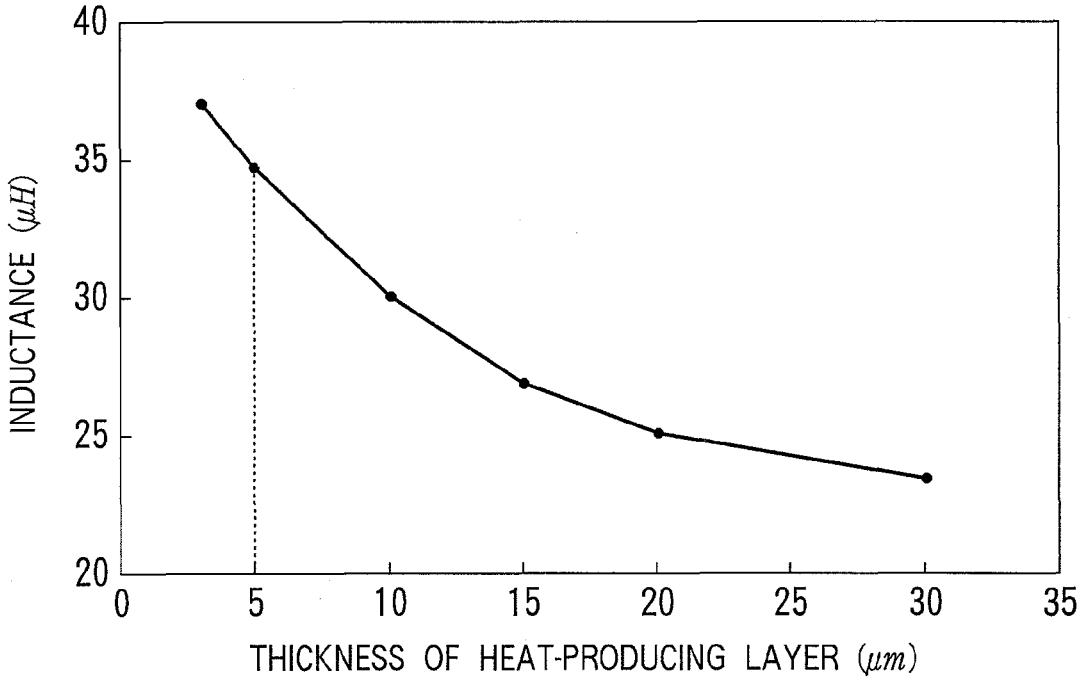
FIG. 4 is a graph in which the inductance of an exciting coil when the exciting coil positioned opposite a heat-producing element is plotted against the thickness of the heat-producing layer (copper)

However, as stated above, the inductance of exciting coil 231 increases as the thickness of heat-producing layer 212 decreases. FIG. 4 is a graph in which the inductance of an exciting coil when the exciting coil positioned opposite a heat-producing element is plotted against the thickness of the heat-producing layer (copper).

As shown in FIG. 4, when the thickness of heat-producing layer 212 is 5 (μm), the inductance of exciting coil 231 has a high value of approximately 35 (μH). When the inductance of exciting coil 231 is of such a high value, it becomes difficult for an induction current to flow in heat-producing layer 212, and electromagnetic coupling between exciting coil unit 230 and heat-producing layer 212 decreases.

Figure 5:
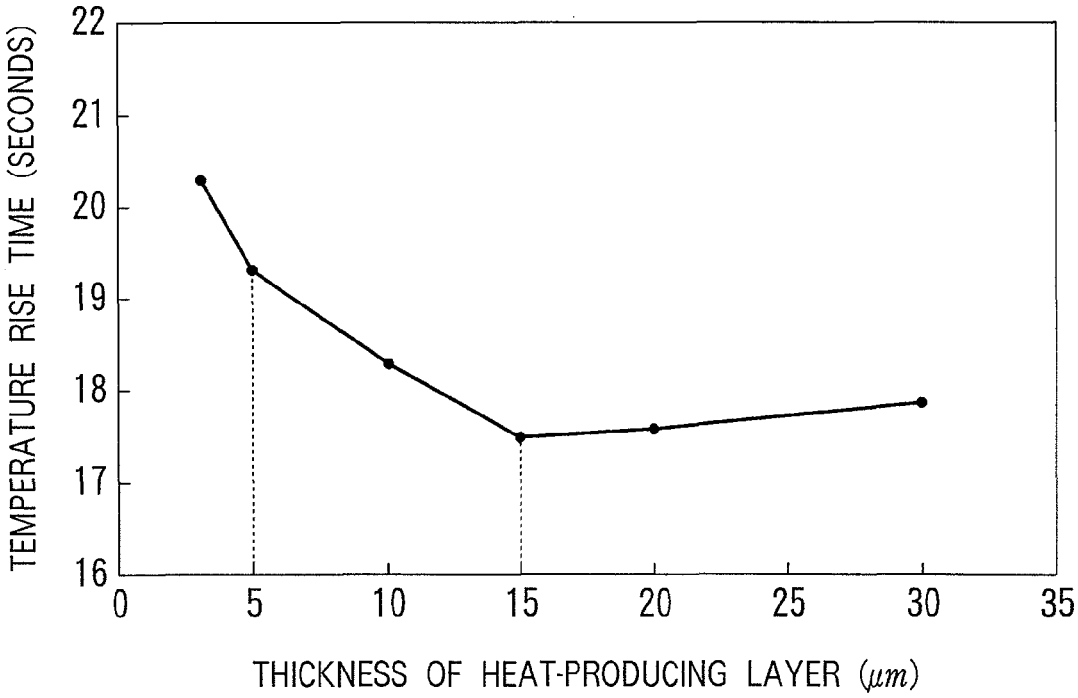
FIG. 5 is a graph showing the relationship between the temperature rise time until the temperature of the heat-producing layer (copper) of a heat-producing roller is raised to a target temperature and the thickness of the heat-producing layer.

FIG. 5 is a graph showing the relationship between the temperature rise time until the temperature of the heat-producing layer (copper) of a heat-producing roller is raised to a target temperature and the thickness of the heat-producing layer.

As shown in FIG. 5, the temperature rise time until heat-producing layer 212 of heat-producing roller 210 is heated to a target heat production temperature (here, the optimal fixing temperature) becomes shorter (faster) when the thickness of heat-producing layer 212 exceeds 5 (μm), and begins gradually to become longer (slower) due to an increase in the thermal capacity of heat-producing layer 212 when the thickness of heat-producing layer 212 is 15 (μm) or more.

As is clear from FIG. 5, the smaller the thickness of heat-producing layer 212 of heat-producing roller 210, the steeper is the gradient of the graph, and therefore the temperature rise time of heat-producing layer 212 varies greatly with a slight difference in the thickness of heat-producing layer 212. This means that, in a conventional fixing apparatus with a thin heat-producing layer 212, major nonuniformity of heat production occurs due to slight differences in the thickness of heat-producing layer 212.

According to an experiment conducted by the present inventors, as shown in Table 1 below, when the thickness error of a copper heat-producing layer 212 was ±2 (μM), the heat production nonuniformity of heat-producing layer 212 was ±8(° C.) when the average thickness of heat-producing layer 212 was 5 (μm), and ±4(° C.) when the average thickness of heat-producing layer 212 was 10 (μm).

TABLE 1

| Thickness of Heat-Producing Layer | Heat Production Nonuniformity |
|---|---|
| 5 ± 2 (μm) | ±8 (° C.) |
| 10 ± 2 (μm) | ±4 (° C.) |

To obtain a satisfactory fixed image with this kind of image forming apparatus 100, it is generally desirable for the temperature nonuniformity of heat-producing layer 212 of heat-producing roller 210 in fixing apparatus 200 to be within ±5(° C.). Therefore, when the average thickness of heat-producing layer 212 of heat-producing roller 210 is made 5 (μm) as in a conventional fixing apparatus, it is necessary for the heat-producing layer 212 thickness error to be made an exacting ±1 (μm).

That is to say, as stated above, in heat-producing layer 212 of heat-producing roller 210, an eddy current I is generated by electromagnetic induction, and heat $RI^2$ proportional to resistance R of heat-producing layer 212 is generated. As the calorific value of heat-producing layer 212 is proportional to resistance R of heat-producing layer 212 in this way, the smaller the average thickness of heat-producing layer 212, the relatively greater is the percentage of the heat-producing layer 212 thickness error, and the greater is the tendency for nonuniformity of heat production to occur.

Consequently, when the average thickness of heat-producing layer 212 of heat-producing roller 210 is made 5 (μm) as in a conventional fixing apparatus, nonuniformity of heat-producing layer 212 heat production is prone to occur, and the temperature rise time of heat-producing layer 212 varies greatly due to even a comparatively small average thickness error.

Thus, when both the resistance value (heat production efficiency) of heat-producing layer 212 and the inductance (electromagnetic coupling) of exciting coil 231 are taken into consideration, 5 (μm) cannot necessarily be said to be the optimal thickness for heat-producing layer 212 of heat-producing roller 210.

It can be seen from Table 1 that an average thickness of 8 (μm) is necessary to achieve heat production nonuniformity of ±5(° C.) with a heat-producing layer 212 thickness error of ±2 (μm). According to FIG. 5, even if the thickness of heat-producing layer 212 exceeds 25 (μm), the temperature rise time is not shortened due to the increase in thermal capacity. Also, when heat-producing layer 212 is formed by means of a plating process, if heat-producing layer 212 is too thick, heat production nonuniformity is prone to occur due to increased roughness of the plating surface.

From the above, in fixing apparatus 200 according to Embodiment 1, when heat-producing layer 212 is formed from copper with a specific resistance of 1.7 (μ'Ωcm), the average thickness of heat-producing layer 212 should be 8 to 25 (μm), with a thickness error of 2 (μm) or less. By this means, a heat-producing roller 210 with a short temperature rise time and good temperature uniformity can be achieved.

If the specific resistance of the material of heat-producing layer 212 is designated ρ, and the thickness of heat-producing layer 212 is designated δ, resistance R of heat-producing layer 212 is expressed as R=ρ/δ. Therefore, the material of heat-producing layer 212 is not limited to copper, and the same kind of effect can also be obtained if another material is used, as long as resistance R is made the same.

That is to say, when the specific resistance of the material of heat-producing layer 212 of heat-producing roller 210 is ρ (μ'Ωcm), the average thickness should be made greater than or equal to 5ρ (μm) and less than or equal to 15ρ (μm), and the thickness error less than or equal to 1.2ρ (μm).

For example, if heat-producing layer 212 is formed from aluminum with a specific resistance of 2.6 (μ'Ωcm), the average thickness of heat-producing layer 212 should be made 13 to 40 (μm), and the thickness error of heat-producing layer 212, 3 (μm).

Figure 6:
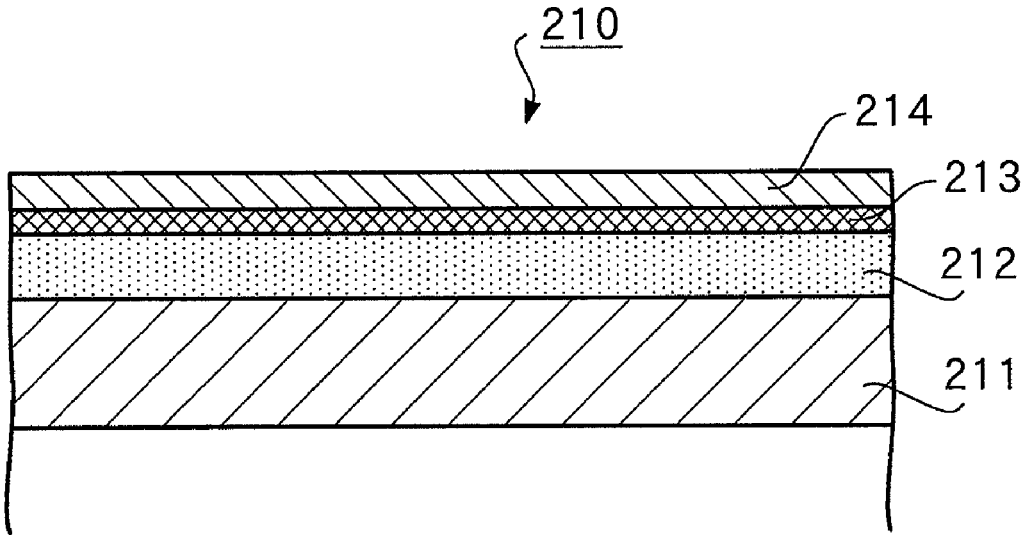
FIG. 6 is a partial enlarged cross-sectional diagram showing the structure of a heat-producing roller in a fixing apparatus according to Embodiment 1 of the present invention.

FIG. 6 is a partial enlarged cross-sectional diagram showing the structure of a heat-producing roller in a fixing apparatus according to Embodiment 1 of the present invention. As shown in FIG. 6, heat-producing roller 210 in fixing apparatus 200 of this example is configured, for example, by forming a heat-producing layer 212 comprising a nonmagnetic electrically conductive layer on the outer peripheral surface (exciting coil 231 side) of roller member 211 made of iron, stainless steel, or the like.

Heat-producing layer 212 is of a nonmagnetic material such as copper, for example, and is formed on the outer peripheral surface of roller member 211 by performing plating, metallizing, or processing using a clad metal. If a tubular heat-producing roller 210 is used as a heat-producing element as in fixing apparatus 200 of this example, heat-producing layer 212 can be formed on the surface of roller member 211 by means of inexpensive plating processing. It is desirable for a material with a specific resistance of 10 (μ'Ωcm) or less to be used for this heat-producing layer 212, and aluminum, silver, gold, and so forth may be used in addition to copper.

A protective layer 213 is formed on the surface of heat-producing layer 212, and a release layer 214 is formed on the surface of protective layer 213.

Protective layer 213 is of nickel 2 to 5 (μm) thick, for example, formed, for instance, by means of plating, metallizing, or clad metal processing. By covering the surface of heat-producing layer 212, protective layer 213 improves the durability of heat-producing layer 212 by preventing oxidation, and also improves the adhesion of release layer 214 and prevents peeling. Instead of a nickel layer, chromium, zinc, or the like 2 to 10 (μm) thick may be used as protective layer 213. If protective layer 213 is less than 2 (μm) thick, its protective effect may be inadequate, whereas if it is more than 10 (μm) thick, the thermal capacity of protective layer 213 will increase and warm-up will take time.

Release layer 214 is, for example, a 20 (μm) thick layer of fluororesin such as PTFE, PFA, or FEP, formed so as to cover the outer peripheral surface of heat-producing roller 210.

It is desirable for heat-producing roller 210 of fixing apparatus 200 of this example to be configured with a silicone rubber layer provided between protective layer 213 and release layer 214 to give the surface resiliency. The total thickness of heat-producing roller 210 comprising these layers should preferably be approximately 100 to 1000 (μm). When plating processing is used for heat-producing layer 212, nickel plating may be performed on roller member 211 as surface treatment prior to plating.

Embodiment 2

Figure 7:
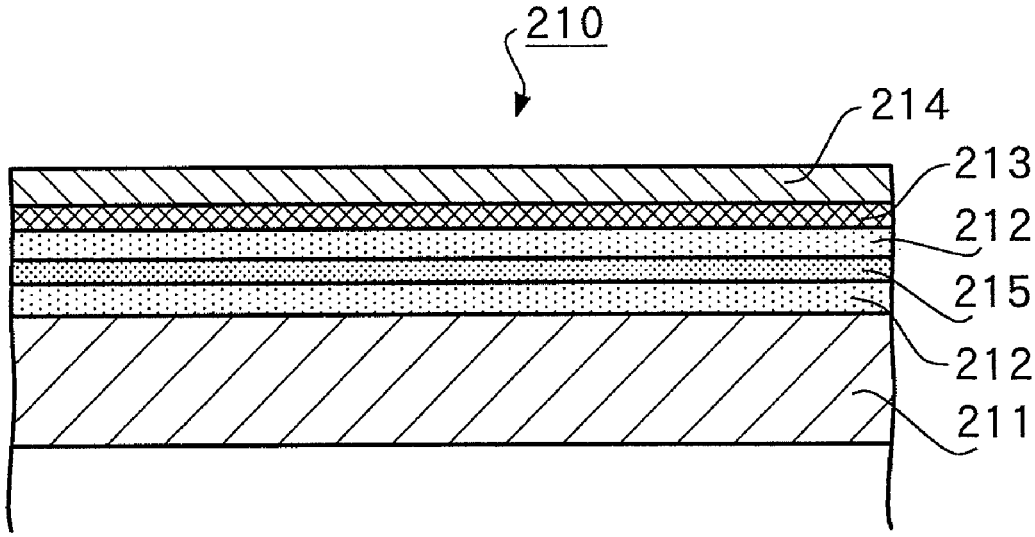
FIG. 7 is a partial enlarged cross-sectional diagram showing the structure of a heat-producing roller in a fixing apparatus according to Embodiment 2 of the present invention.

Next, a fixing apparatus according to Embodiment 2 of the present invention will be described. FIG. 7 is a partial enlarged cross-sectional diagram showing the structure of a heat-producing roller in a fixing apparatus according to Embodiment 2 of the present invention. A fixing apparatus according to Embodiment 2 differs from fixing apparatus 200 according to Embodiment 1 only in the configuration of heat-producing roller 210 and heat-producing layer 212, with the rest of the configuration being common to both embodiments, and therefore a description of the configuration of common parts is omitted here.

As shown in FIG. 7, heat-producing roller 210 in a fixing apparatus of this example has a configuration in which heat-producing layer 212 of heat-producing roller 210 in fixing apparatus 200 according to Embodiment 1 is separated into two layers by a separation layer 215. It is desirable for this separation layer 215 to be formed from nickel 2 to 5 (μm) thick, for example.

Using this kind of configuration enables a thick heat-producing layer 212 with a small thickness error to be formed easily.

That is to say, if a single thick heat-producing layer 212 with an average thickness of 24 (μm), for example, is formed on the outer peripheral surface of roller member 211 by means of plating processing, a large thickness error is prone to occur because heat-producing layer 212 is excessively thick. Also, such a heat-producing layer 212 formed by means of plating processing is prone to the occurrence of heat production nonuniformity due to roughness of the plating surface.

In contrast, since heat-producing roller 210 in a fixing apparatus of this example is configured with heat-producing layer 212 separated by separation layer 215 into two layers with an average thickness of 12 (μm), as described above, each layer can be kept thin, and the thickness error of heat-producing layer 212 due to plating processing can be kept small.

Also, with heat-producing roller 210 in a fixing apparatus of this example, since the thickness of each heat-producing layer 212 is smaller, plating surface roughness is reduced, and heat production nonuniformity is not prone to occur.

Furthermore, since heat-producing roller 210 in a fixing apparatus of this example is configured with heat-producing layer 212 separated into two layers by separation layer 215, the locations of pinholes occurring in heat-producing layers 212 due to plating processing will very rarely coincide in both heat-producing layers 212, and the occurrence of temperature nonuniformity due to these pinholes can be reduced.

Here, a configuration has been assumed in which heat-producing layer 212 of heat-producing roller 210 is separated into two layers as shown in FIG. 7, but this heat-producing layer 212 may also be separated into three or more layers.

It is desirable for the specific resistance of separation layer 215 of heat-producing roller 210 in a fixing apparatus of this example to be higher than the specific resistance of each heat-producing layer 212. Thus, if separation layer 215 is formed from nickel 2 to 5 (μm) thick, for example, the resistance of separation layer 215 is higher than the resistance of each heat-producing layer 212, and therefore an induction current flows in heat-producing layers 212, and the same kind of effect can be obtained as with heat-producing layer 212 of heat-producing roller 210 in fixing apparatus 200 according to Embodiment 1. The resistance of separation layer 215 can also be made higher than the resistance of each heat-producing layer 212 by making separation layer 215 thin.

Embodiment 3

Figure 8:
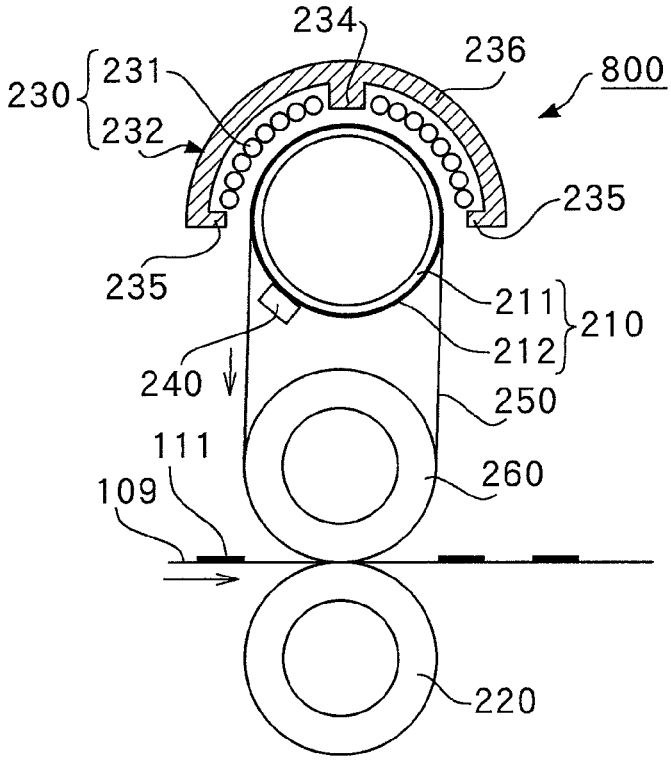
FIG. 8 is a schematic cross-sectional drawing showing the configuration of the principal parts of a fixing apparatus according to Embodiment 3 of the present invention.

Next, a fixing apparatus according to Embodiment 3 of the present invention will be described. FIG. 8 is a schematic cross-sectional drawing showing the configuration of the principal parts of a fixing apparatus according to Embodiment 3 of the present invention. A fixing apparatus according to Embodiment 3 differs in configuration from fixing apparatus 200 according to Embodiment 1 only in that heat of heat-producing layer 212 of heat-producing roller 210 is transmitted to recording paper 109 by means of a fixing belt, with the rest of the configuration being common to both embodiments, and therefore a description of the configuration of common parts is omitted here.

As shown in FIG. 8, a fixing apparatus 800 of this example is configured so that heat of heat-producing layer 212 of heat-producing roller 210 is transmitted to recording paper 109 by means of a fixing belt 250.

In FIG. 8, fixing belt 250 is suspended over a fixing roller 260 that rotates while pressing against pressure roller 220, and heat-producing roller 210, and is rotated in the direction indicated by the arrow (anticlockwise) by the rotation of pressure roller 220.

Recording paper 109 is transported in the direction indicated by the arrow by means of a nip between pressure roller 220 and fixing belt 250 formed by fixing roller 260 pressing against pressure roller 220 via fixing belt 250. By this means, heat of heat-producing layer 212 of heat-producing roller 210 is transmitted to recording paper 109 via fixing belt 250, and unfixed toner image 111 formed on recording paper 109 is heat-fixed onto recording paper 109.

In fixing apparatus 800 according to Embodiment 3, stress due to the pressure of pressure roller 220 is not exerted on heat-producing layer 212 of heat-producing roller 210 as in fixing apparatus 200 according to Embodiment 1 shown in FIG. 2, and therefore damage to heat-producing layer 212 of heat-producing roller 210 can be prevented. Also, the life of heat-producing layer 212 is extended, and reliability is improved.

In fixing apparatus 800 of this example, roller member 211 of heat-producing roller 210 is made of a magnetic material such as iron, for example.

By making roller member 211 of heat-producing roller 210 of a magnetic material in this way, roller member 211 becomes ferromagnetic, and therefore magnetic flux penetrating heat-producing layer 212 of heat-producing roller 210 increases, and the temperature of heat-producing layer 212 is raised rapidly.

Also, making roller member 211 of heat-producing roller 210 of iron means that the thermal conductivity of roller member 211 is high, and therefore temperature uniformity can be achieved through heat transfer in the lengthwise direction (rotation axis direction) of heat-producing roller 210.

Furthermore, making roller member 211 of heat-producing roller 210 of iron enables roller member 211 to be fabricated simply and inexpensively.

In fixing apparatus 200 according to Embodiment 1, release layer 214 is formed on heat-producing roller 210, but in fixing apparatus 800 of this example, release layer 214 is provided on the surface of fixing belt 250. Thus, heat-producing roller 210 has a configuration in which its surface is covered by protective layer 213. Therefore, in fixing apparatus 800 of this example, protective layer 213 on the surface of heat-producing roller 210 has a function of preventing wear of heat-producing layer 212 due to contact with fixing belt 250. This function of protective layer 213 is extremely important since heat-producing layer 212 is made of a soft nonmagnetic material such as copper or aluminum, and a change in its thickness due to wear has a great effect on heat production.

Also, since fixing apparatus 800 of this example has a configuration whereby heat generated by heat-producing roller 210 is transmitted to fixing belt 250, temperature nonuniformity will occur in fixing belt 250 if contact between fixing belt 250 and heat-producing roller 210 is poor. If heat-producing layer 212 is too thick, the plating surface will be rough, resulting in nonuniformity of heat transmission to fixing belt 250, and therefore care must be taken with the plating processing.

Embodiment 4

Figure 9:
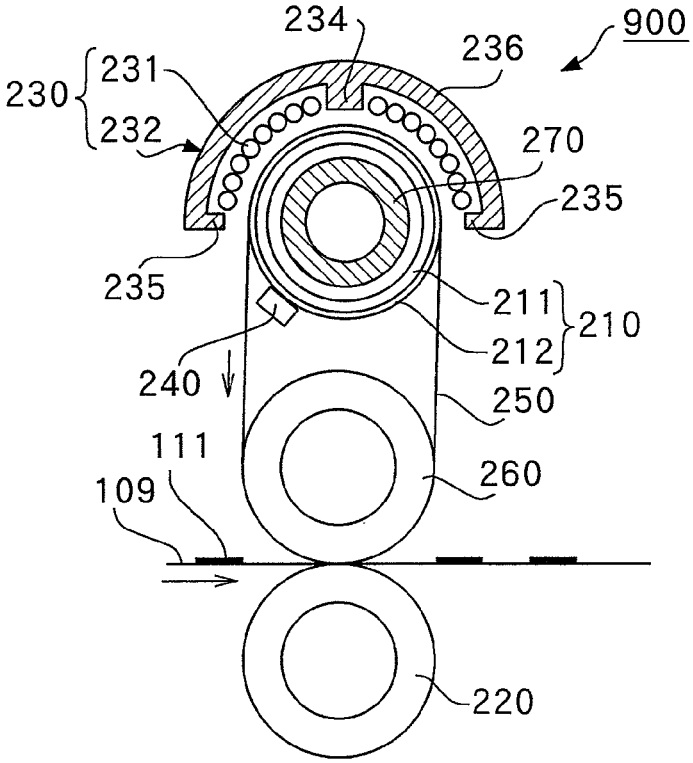
FIG. 9 is a schematic cross-sectional drawing showing the configuration of the principal parts of a fixing apparatus according to Embodiment 4 of the present invention.

Next, a fixing apparatus according to Embodiment 4 of the present invention will be described. FIG. 9 is a schematic cross-sectional drawing showing the configuration of the principal parts of a fixing apparatus according to Embodiment 4 of the present invention. A fixing apparatus according to Embodiment 4 differs in configuration from fixing apparatus 800 according to Embodiment 3 only in that an inner core of ferromagnetic material is provided inside heat-producing roller 210, with the rest of the configuration being common to both embodiments, and therefore a description of the configuration of common parts is omitted here.

As shown in FIG. 9, a fixing apparatus 900 of this example has a configuration in which an inner core 270 of a ferromagnetic material such as ferrite or permalloy is provided internally. Also, roller member 211 of heat-producing roller 210 in fixing apparatus 900 of this example is made of a nonmagnetic material with low electrical conductivity.

In fixing apparatus 900 of this example, since inner core 270 of ferromagnetic material is used, magnetic flux that penetrates heat-producing layer 212 of heat-producing roller 210 further increases, and the temperature of heat-producing layer 212 is raised rapidly.

Also, in fixing apparatus 900 of this example, since roller member 211 of heat-producing roller 210 is made of a nonmagnetic material with low electrical conductivity that allows magnetic flux to pass through, such as stainless steel, for example, magnetic flux that passes through can be increased by means of inner core 270.

Furthermore, the thickness of roller member 211 can be reduced to a level that enables the necessary mechanical strength to be achieved, and if this thickness is made 0.04 mm to 0.2 mm, for example, the thermal capacity of roller member 211 is reduced, and the temperature rise time of fixing belt 250 is shortened.

Embodiment 5

Figure 10:
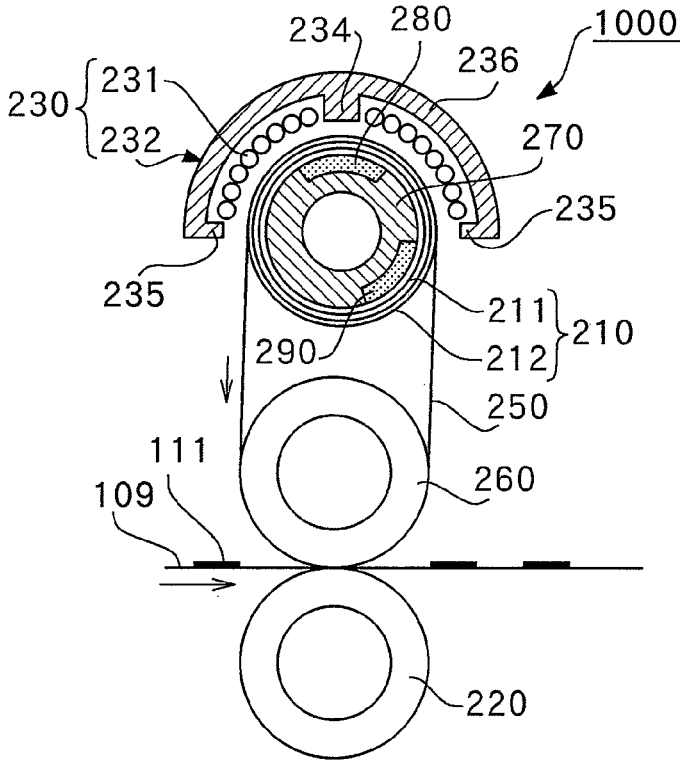
FIG. 10 is a schematic cross-sectional drawing showing the configuration of the principal parts of a fixing apparatus according to Embodiment 5 of the present invention.

Next, a fixing apparatus according to Embodiment 5 of the present invention will be described. FIG. 10 is a schematic cross-sectional drawing showing the configuration of the principal parts of a fixing apparatus according to Embodiment 5 of the present invention. A fixing apparatus according to Embodiment 5 differs from fixing apparatus 900 according to Embodiment 4 only in the configuration of the inner core, with the rest of the configuration being common to both embodiments, and therefore a description of the configuration of common parts is omitted here.

As shown in FIG. 10, a fixing apparatus 1000 of this example has a configuration in which an inner core 270 of a ferromagnetic material such as ferrite or permalloy is provided inside heat-producing roller 210, and electrically conductive magnetism masking elements 280 and 290 of copper, aluminum, or the like, with a thickness of approximately 1 mm, are provided on the peripheral surface of inner core 270 opposite a paper non-passage area of heat-producing roller 210. Magnetism masking elements 280 and 290 are displaced by rotating inner core 270.

In fixing apparatus 1000 of this example, since magnetism masking elements 280 and 290 have ample skin depth, an eddy current is generated therein and a repulsive field is created, and a rise in temperature of a paper non-passage area can be further reduced. That is to say, with fixing apparatus 1000 of this example, positioning magnetism masking element 280 opposite the winding center (center core 234) of exciting coil 231, as shown in FIG. 10, weakens the magnetic flux of a paper non-passage area, and enables an excessive rise in temperature of a paper non-passage area of heat-producing roller 210 to be suppressed. Magnetism masking elements 280 and 290 have different widths, and either can be selected according to the width of recording paper 109 fed to fixing apparatus 1000.

Thus, with fixing apparatus 1000, since magnetic flux passes through heat-producing layer 212, control of magnetic flux of a paper non-passage area is possible by means of inner core 270 and magnetism masking elements 280 and 290.

Embodiment 6

Figure 11:
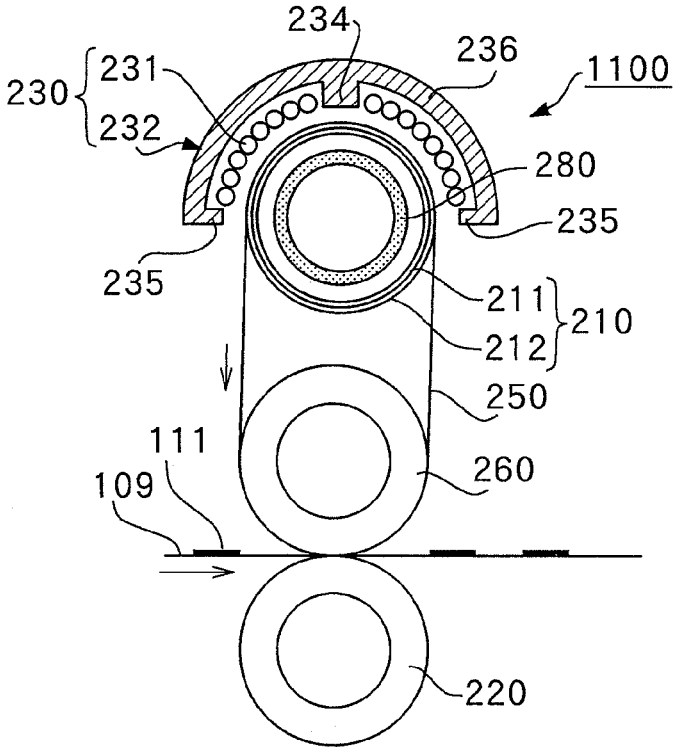
FIG. 11 is a schematic cross-sectional drawing showing the configuration of the principal parts of a fixing apparatus according to Embodiment 6 of the present invention.

Next, a fixing apparatus according to Embodiment 6 of the present invention will be described. FIG. 11 is a schematic cross-sectional drawing showing the configuration of the principal parts of a fixing apparatus according to Embodiment 6 of the present invention. A fixing apparatus according to Embodiment 6 differs from fixing apparatus 800 according to Embodiment 3 only in the configuration of roller member 211 of heat-producing roller 210, with the rest of the configuration being common to both embodiments, and therefore a description of the configuration of common parts is omitted here.

As shown in FIG. 11, in a fixing apparatus 1100 of this example, roller member 211 of heat-producing roller 210 is made of a temperature sensitive magnetic alloy that has magnetic properties at room temperature but loses its magnetic properties at a predetermined temperature or above. Fixing apparatus 1100 shown in FIG. 11 has a configuration in which a cylindrical magnetism masking element 280 is provided, but a configuration in which magnetism masking element 280 is not provided may also be used.

In FIG. 11, if small-size recording paper 109 is fed continuously, heat of a paper non-passage area of heat-producing roller 210 is not absorbed by recording paper 109, and the temperature of a paper non-passage area rises. If the temperature of a paper non-passage area of heat-producing roller 210 becomes higher than the Curie temperature as a result, roller member 211 of heat-producing roller 210 made of a temperature sensitive magnetic alloy loses its magnetic properties, and the magnetic flux of a paper non-passage area weakens. If magnetism masking element 280 is provided, a repulsive field is generated by magnetism masking element 280 and the magnetic flux of a paper non-passage area weakens further. By this means, a rise in temperature of a paper non-passage area is reduced.

When roller member 211 is made of a temperature sensitive magnetic alloy for which the Curie temperature is set so as to be a predetermined temperature in this way, it is desirable for the thickness of roller member 211 to be 100 to 1000 (μm).

An alloy of iron and nickel or an alloy of iron, nickel, and chromium, for example, is used as the temperature sensitive magnetic alloy of which roller member 211 is formed. The Curie temperature of the temperature sensitive magnetic alloy can be set to a predetermined temperature by adjusting the proportions of each of these metals. In this example, the Curie temperature of the temperature sensitive magnetic alloy of which roller member 211 is formed is set to 220 degrees, close to the toner fixing temperature. As a result, roller member 211 exhibits the properties of a ferromagnetic body at a temperature of 220 degrees or below, but exhibits the properties of a nonmagnetic body when the temperature exceeds 220 degrees. The Curie temperature is not limited to 220 degrees, and may be set to a lower temperature.

Generally, since the inductance of a temperature sensitive magnetic alloy is high, high power input of 1000 W or more is difficult with a general-purpose exciting circuit. With fixing apparatus 1100 of this example, since inductance is reduced by forming heat-producing layer 212 on a temperature sensitive magnetic alloy, high-power input is possible even with a general-purpose exciting circuit.

Embodiment 7

Figure 12:
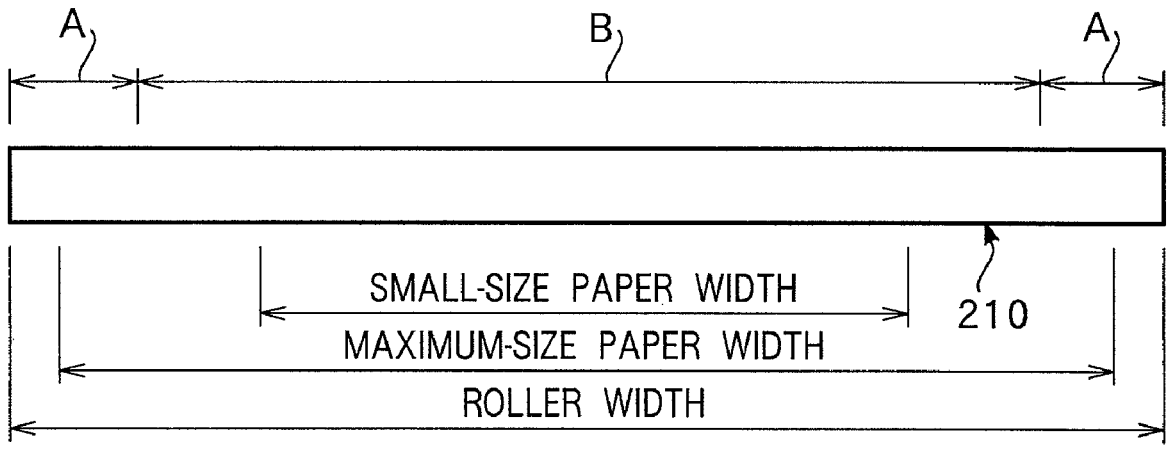
FIG. 12 is a schematic plan view showing the configuration of a principal part of a fixing apparatus according to Embodiment 7 of the present invention.

Next, a fixing apparatus according to Embodiment 7 of the present invention will be described. FIG. 12 is a schematic plan view showing the configuration of a principal part of a fixing apparatus according to Embodiment 7 of the present invention. A fixing apparatus according to Embodiment 7 differs from the above-described fixing apparatuses only in the configuration of heat-producing layer 212 of heat-producing roller 210, with the rest of the configuration being common to the embodiments, and therefore a description of the configuration of common parts is omitted here.

In this kind of fixing apparatus, the temperature of either end of heat-producing roller 210 is prone to fall due to heat dissipation to the outside.

Thus, in heat-producing roller 210 in a fixing apparatus of this example, heat-producing layer 212 has an area in which the average thickness is greater than or equal to 5ρ (μm) and less than or equal to 15ρ (μm), and the thickness error is less than or equal to 1.2ρ (μm), and a part in which the temperature falls due to heat dissipation is formed more thinly than the aforementioned area. Specifically, referring to FIG. 12, end parts A of heat-producing layer 212 are formed more thinly than center part B.

For example, if center part B of heat-producing layer 212 of heat-producing roller 210 is formed of copper plating with a thickness of 10 (μm), end parts A of heat-producing layer 212 are formed to a thickness of 8 (μm), 2 (μm) thinner than center part B.

As a result of forming end parts A of heat-producing layer 212 of heat-producing roller 210 more thinly than center part B in this way, the resistance value of end parts A of heat-producing layer 212 is higher, and the calorific value of end parts A increases. According to Table 1, the calorific value of end parts A increases by 4° C. compared with center part B. That is to say, compensating for heat dissipation to the outside with an increase in heat production makes it possible to achieve temperature uniformity of the entire paper passage area of heat-producing roller 210.

With electroplating that forms heat-producing layer 212, it is possible to vary the plating thickness by placing an electrode on roller member 211 corresponding to an area at which the plating is to be made thinner. In order to compensate for a fall in temperature due to absorption of heat by magnetism masking elements 280 and 290 when magnetism masking element 280 or magnetism masking element 290 of fixing apparatus 1000 is not opposite the winding center of exciting coil 231, temperature uniformity may be achieved by forming heat-producing layer 212 corresponding to magnetism masking elements 280 and 290 more thinly.

It is desirable for heat-producing layer 212 of heat-producing roller 210 to be formed on the outer peripheral surface of roller member 211 of heat-producing roller 210—that is, the side opposite exciting coil 231—as described above. By forming heat-producing layer 212 on the side opposite exciting coil 231 in this way, magnetic flux can be utilized effectively, and heat-producing layer 212 consequently rises in temperature rapidly. Conversely, if heat-producing layer 212 is formed on the inner peripheral surface side of roller member 211 of heat-producing roller 210, heat-producing layer 212 does not produce heat effectively. For example, in the case of fixing apparatus 800, there is a sharp decrease in magnetic flux reaching as far as heat-producing layer 212 due to the magnetic properties of iron roller member 211, and therefore the calorific value falls. Also, in the case of fixing apparatus 900, magnetic flux is weakened by the slight electrical conductivity of stainless steel roller member 211, and therefore magnetic flux passing through heat-producing layer 212 decreases, and the calorific value falls.

Also, it is desirable for exciting coil 231 to be located outside heat-producing roller 210. By locating exciting coil 231 outside heat-producing roller 210 in this way, heat-producing layer 212 can be formed on the outer surface of heat-producing roller 210, and it is possible for heat-producing layer 212 to be formed by means of inexpensive plating processing.

Furthermore, when exciting coil 231 is positioned opposite heat-producing roller 210, it is desirable for the inductance of exciting coil 231 at a frequency of 30 (kHz) to be greater than or equal to 10 (μH) and less than or equal to 50 (μH), and its electrical resistance to be greater than or equal to 0.5 ('Ω) and less than or equal to 5 ('Ω). This enables an inexpensive general-purpose exciting circuit to be used.

Moreover, it is desirable for a current with a frequency of 20 to 100 (kHz) to be applied to exciting coil 231. This suppresses exciting circuit power loss, and enables the temperature of heat-producing layer 212 to be raised rapidly.

A heating apparatus of a first aspect of the present invention employs a configuration that includes a magnetic flux generation section that generates magnetic flux, and a heat-producing element having an electrically conductive heat-producing layer that is induction-heated by magnetic flux generated by the magnetic flux generation section, wherein, when the specific resistance of the material of the heat-producing layer is designated ρ (μ'Ωcm), the heat-producing layer has an area in which the average thickness is greater than or equal to 5ρ (μm) and less than or equal to 15ρ (μm), and the thickness error is less than or equal to 1.2ρ (μm).

According to this configuration, the temperature rise time until the temperature of the heat-producing element is raised to a target temperature can be shortened, and uniformity of the temperature of the heat-producing element can be ensured.

A heating apparatus of a second aspect of the present invention employs a configuration wherein, in the above first aspect, the heat-producing layer comprises a plurality of layers.

According to this configuration, the thickness of each heat-producing layer can be reduced, and therefore the thickness error of heat-producing layers in plating processing is made smaller. Also, the surface of the heat-producing layers can be prevented from becoming rough due to plating processing. Furthermore, as there are multiple heat-producing layers, the locations of pinholes occurring due to plating processing differ in each layer, enabling temperature nonuniformity of the heat-producing element to be reduced.

A heating apparatus of a third aspect of the present invention employs a configuration wherein, in the above second aspect, the heat-producing layer is separated into a plurality of layers by a separation layer having a higher specific resistance than the heat-producing layer.

According to this configuration, since the specific resistance of the separation layer is high, an induction current flows in the heat-producing layers, and the same kind of effect can be obtained as with the heating apparatus of the first aspect.

A heating apparatus of a fourth aspect of the present invention employs a configuration wherein, in the above first aspect, the heat-producing layer is of copper with an average thickness greater than or equal to 8 (μm) and less than or equal to 25 (μm), and a thickness error less than or equal to 2 (μm).

According to this configuration, the temperature rise time until the temperature of the heat-producing element is raised to a target temperature can be shortened, and uniformity of the temperature of the heat-producing element can be ensured.

A heating apparatus of a fifth aspect of the present invention employs a configuration wherein, in the above first aspect, the heat-producing layer is of aluminum with an average thickness greater than or equal to 13 (μm) and less than or equal to 40 (μm), and a thickness error less than or equal to 3 (μm).

According to this configuration, the temperature rise time until the temperature of the heat-producing element is raised to a target temperature can be shortened, and uniformity of the temperature of the heat-producing element can be ensured.

A heating apparatus of a sixth aspect of the present invention employs a configuration wherein, in the above third aspect, the separation layer is of nickel.

According to this configuration, when, for example, the separation layer is formed of nickel 2 to 5 (μm) thick, the specific resistance of the separation layer becomes higher than the specific resistance of each heat-producing layer and an induction current flows in the heat-producing layers, and the same kind of effect can be obtained as with the heating apparatus of the first aspect.

A heating apparatus of a seventh aspect of the present invention employs a configuration wherein, in the above first aspect, a part of the heat-producing layer in which the temperature falls due to heat dissipation is formed more thinly than another part so as to have a thickness that enables calorific value compensation equivalent to the fall in temperature.

According to this configuration, since both end parts of the heat-producing layer which are prone to fall due to heat dissipation to the outside are thin, the resistance value of both end parts of the heat-producing layer rises and the calorific value increases, and it is possible to achieve temperature uniformity of the entire paper passage area of the maximum-size paper width.

A heating apparatus of an eighth aspect of the present invention employs a configuration wherein, in the above first aspect, a protective layer is formed on the surface of the heat-producing layer.

According to this configuration, the heat-producing layer can be shielded from the air by the protective layer, enabling corrosion of the heat-producing layer to be prevented. Also, with a configuration in which a fixing belt that heat-fixes unfixed toner on a fed recording medium is used to transmit heat of the heat-producing layer to the recording medium, wear of the heat-producing layer due to contact with the fixing belt can be prevented by the protective layer.

A heating apparatus of a ninth aspect of the present invention employs a configuration wherein, in the above eighth aspect, the protective layer is of nickel.

According to this configuration, the protective layer can be formed by means of inexpensive plating processing.

A heating apparatus of a tenth aspect of the present invention employs a configuration wherein, in the above eighth aspect, a release layer is formed on the surface of the heat-producing element.

According to this configuration, after passage through the nip, recording paper separates easily from the surface of the heat-producing element due to the release layer.

A heating apparatus of an eleventh aspect of the present invention employs a configuration wherein, in the above first aspect, the heat-producing element is provided with a rotating heat-producing roller, and the heat-producing layer is formed on a roller member of the heat-producing roller.

According to this configuration, the heat-producing layer can be formed by means of inexpensive plating processing.

A heating apparatus of a twelfth aspect of the present invention employs a configuration wherein, in the above eleventh aspect, the heat-producing layer is formed on the heat-producing roller by means of plating processing.

According to this configuration, high-speed, high-volume heat-producing layer formation is possible by means of plating processing line automation.

A heating apparatus of a thirteenth aspect of the present invention employs a configuration wherein, in the above eleventh aspect, there are further provided a fixing belt suspended on the heat-producing roller, and a pressure section that forms a nip area with the fixing belt.

According to this configuration, stress of the pressure section for fixing an unfixed image onto recording paper is not exerted on the heat-producing layer of the heat-producing roller, enabling damage to the heat-producing layer to be prevented.

A heating apparatus of a fourteenth aspect of the present invention employs a configuration wherein, in the above eleventh aspect, the roller member of the heat-producing roller is made of a magnetic material.

According to this configuration, since the roller member is ferromagnetic, magnetic flux that penetrates the heat-producing layer increases, and the temperature of the heat-producing layer can be raised rapidly. Also, since the thermal conductivity of the roller member is good, temperature uniformity of the heat-producing roller can be achieved through heat transfer in the lengthwise direction of the roller member. Furthermore, the roller member can be fabricated simply and inexpensively.

A heating apparatus of a fifteenth aspect of the present invention employs a configuration wherein, in the above eleventh aspect, the roller member is made of a nonmagnetic material with low electrical conductivity, and an inner core of a ferromagnetic material is provided inside the roller member.

According to this configuration, magnetic flux that penetrates the heat-producing layer further increases due to the inner core, and the temperature of the heat-producing roller is raised rapidly. Also, since a nonmagnetic material with low electrical conductivity such as stainless steel, for example, allows magnetic flux to pass through, magnetic flux can be increased by means of the inner core.

A heating apparatus of a sixteenth aspect of the present invention employs a configuration wherein, in the above fifteenth aspect, an electrically conductive magnetism masking element is provided inside the roller member.

According to this configuration, positioning a magnetism masking element opposite the winding center of the exciting coil weakens the magnetic flux of a paper non-passage area of the heat-producing roller, and enables an excessive rise in temperature of a paper non-passage area of the heat-producing roller to be suppressed.

A heating apparatus of a seventeenth aspect of the present invention employs a configuration wherein, in the above sixteenth aspect, apart of the heat-producing layer provided with the magnetism masking element is formed more thinly than a part not provided with the magnetism masking element so as to have a thickness that enables calorific value compensation equivalent to a fall in temperature.

According to this configuration, since a part of the heat-producing layer at which the temperature falls due to absorption of heat of a magnetism masking element is thin, the resistance value of this part of the heat-producing layer rises and the calorific value increases, and it is possible to achieve temperature uniformity of the entire paper passage area of the maximum-size paper width.

A heating apparatus of an eighteenth aspect of the present invention employs a configuration wherein, in the above eleventh aspect, the roller member is made of a temperature sensitive magnetic alloy that has magnetic properties at room temperature but loses its magnetic properties at a predetermined temperature or above.

According to this configuration, if small-size paper is fed continuously, the temperature of a paper non-passage area of the heat-producing roller rises, and if the temperature of the temperature sensitive magnetic alloy becomes higher than the Curie temperature, the temperature sensitive magnetic alloy loses its magnetic properties, the magnetic flux of a paper non-passage area weakens, and the rise in temperature of a paper non-passage area of the heat-producing roller is reduced.

A heating apparatus of a nineteenth aspect of the present invention employs a configuration wherein, in the above eighteenth aspect, an electrically conductive magnetism masking element is provided inside the roller member.

According to this configuration, if the temperature of a paper non-passage area of the temperature sensitive magnetic alloy becomes higher than the Curie temperature, the temperature sensitive magnetic alloy loses its magnetic properties, an eddy current is generated in the magnetism masking element and a repulsive field is created, and the rise in temperature of a paper non-passage area of the heat-producing roller can be further reduced.

A heating apparatus of a twentieth aspect of the present invention employs a configuration wherein, in the above eleventh aspect, the heat-producing layer is formed on the side of the roller member opposite the magnetic flux generation section.

According to this configuration, since the heat-producing layer is formed on the side of the roller member opposite the magnetic flux generation section, magnetic flux can be utilized effectively, and the heat-producing layer rises in temperature rapidly.

A heating apparatus of a twenty-first aspect of the present invention employs a configuration wherein, in the above eleventh aspect, the magnetic flux generation section is located outside the heat-producing roller.

According to this configuration, since the magnetic flux generation section is located outside the heat-producing roller, the heat-producing layer can be formed on the outer peripheral surface of the heat-producing roller. That is to say, it is possible for the heat-producing layer to be formed by means of the easy fabrication method of plating processing.

A heating apparatus of a twenty-second aspect of the present invention employs a configuration wherein, in the above first aspect, the magnetic flux generation section is provided with an exciting coil, and when the exciting coil is positioned opposite the heat-producing element, the inductance of the exciting coil at a frequency of 30 (kHz) is greater than or equal to 10 (μH) and less than or equal to 50 (μH), and its electrical resistance is greater than or equal to 0.5 ('Ω) and less than or equal to 5 ('Ω).

According to this configuration, an inexpensive general-purpose exciting circuit can be used.

A heating apparatus of a twenty-third aspect of the present invention employs a configuration wherein, in the above first aspect, the magnetic flux generation section is provided with an exciting coil, and a current with a frequency in the range of 20 to 100 (kHz) is applied to the exciting coil.

According to this configuration, exciting circuit power loss can be suppressed and the temperature of the heat-producing element can be raised rapidly.

A fixing apparatus of a twenty-fourth aspect of the present invention is provided with a heating section that heat-fixes an unfixed image formed on a recording medium, and employs a configuration in which the heating apparatus according to the first aspect is used as the heating section.

According to this configuration, when an unfixed image formed on a recording medium is heat-fixed, the temperature rise time until the temperature of the heat-producing element is raised to a target temperature can be shortened, and uniformity of the temperature of the heat-producing element can be ensured.

An image forming apparatus of a twenty-fifth aspect of the present invention is provided with a fixing section that fixes an unfixed image formed on a recording medium, and employs a configuration in which the fixing apparatus of the twenty-fourth aspect is used as the fixing section.

According to this configuration, when an unfixed image formed on a recording medium is fixed, the temperature rise time until the temperature of the heat-producing element is raised to a target temperature can be shortened, and uniformity of the temperature of the heat-producing element can be ensured.

The present application is based on Japanese Patent Application No. 2004-354445 filed on Dec. 7, 2004, entire content of which is expressly incorporated herein by reference.

INDUSTRIAL APPLICABILITY

The present invention enables the temperature rise time until the temperature of a heat-producing element is raised to a target temperature to be shortened, and uniformity of the temperature of the heat-producing element to be ensured, and is therefore suitable for use as a heating section of a fixing apparatus in an image forming apparatus such as an electrophotographic or electrostatographic copier, facsimile machine, or printer.

The invention claimed is:

1. A heating apparatus comprising:

a magnetic flux generator that generates magnetic flux; and a heat-producing element having an electrically conductive heat-producing layer that is induction-heated by magnetic flux generated by the magnetic flux generator, wherein, when a specific resistance of a material of the heat-producing layer is designated ρ (μ'Ωm), the heat-producing layer has an area in which an average thickness is greater than or equal to 5ρ (μm) and less than or equal to 15ρ (μm), and a thickness error is less than or equal to 1.2ρ (μm).

2. The heating apparatus according to claim 1, wherein the heat-producing layer comprises a plurality of layers.

3. The heating apparatus according to claim 2, wherein the heat-producing layer is separated into a plurality of layers by a separation layer having a higher specific resistance than the heat-producing layer.

4. The heating apparatus according to claim 1, wherein the heat-producing layer is copper with an average thickness greater than or equal to 8 (μm) and less than or equal to 25 (μm), and a thickness error less than or equal to 2 (μm).

5. The heating apparatus according to claim 1, wherein the heat-producing layer is aluminum with an average thickness greater than or equal to 13 (μm) and less than or equal to 40 (μm), and a thickness error less than or equal to 3 (μm).

6. The heating apparatus according to claim 3, wherein the separation layer is nickel.

7. The heating apparatus according to claim 1, wherein a part of the heat-producing layer in which temperature falls due to heat dissipation is thinner than another part of the heat-producing layer so as to have a thickness that enables calorific value compensation equivalent to a fall in temperature.

8. The heating apparatus according to claim 1, further comprising a protective layer on a surface of the heat-producing layer.

9. The heating apparatus according to claim 8, wherein the protective layer is nickel.

10. The heating apparatus according to claim 8, further comprising a release layer on a surface of the heat-producing element.

11. The heating apparatus according to claim 1, wherein:

the heat-producing element comprises a rotating heat-producing roller; and the heat-producing layer is on a roller member of the heat-producing roller.

12. The heating apparatus according to claim 11, wherein the heat-producing layer is provided on the heat-producing roller by plating.

13. The heating apparatus according to claim 11, further comprising:

a fixing belt suspended on the heat-producing roller; and a pressure member that forms a nip area with the fixing belt.

14. The heating apparatus according to claim 11, wherein the roller member of the heat-producing roller is a magnetic material.

15. The heating apparatus according to claim 11, wherein:

the roller member is a nonmagnetic material with low electrical conductivity; and an inner core of a ferromagnetic material is provided inside the roller member.

16. The heating apparatus according to claim 15, wherein an electrically conductive magnetism mask is provided inside the roller member.

17. The heating apparatus according to claim 16, wherein a part of the heat-producing layer provided with the magnetism mask is thinner than a part of the heat producing layer not provided with the magnetism mask so as to have a thickness that enables calorific value compensation equivalent to a fall in temperature.

18. The heating apparatus according to claim 11, wherein the roller member is a temperature sensitive magnetic alloy that has magnetic properties at room temperature but loses magnetic properties at or above a predetermined temperature.

19. The heating apparatus according to claim 18, wherein an electrically conductive magnetism mask is provided inside the roller member.

20. The heating apparatus according to claim 11, wherein the heat-producing layer is on a side of the roller member opposite the magnetic flux generator.

21. The heating apparatus according to claim 11, wherein the magnetic flux generator is located outside the heat-producing roller.

22. The heating apparatus according to claim 1, wherein:

the magnetic flux generator comprises an exciting coil; and when the exciting coil is positioned opposite the heat-producing element, inductance of the exciting coil at a frequency of 30 (kHz) is greater than or equal to 10 (μH) and less than or equal to 50 (μH), and electrical resistance thereof is greater than or equal to 0.5 ('Ω) and less than or equal to 5 ('Ω).

23. The heating apparatus according to claim 1, wherein:

the magnetic flux generator comprises an exciting coil; and a current with a frequency in a range of 20 to 100 (kHz) is applied to the exciting coil.

24. A fixing apparatus comprising a heating section that heat-fixes an unfixed image formed on a recording medium, wherein the fixing apparatus uses the heating apparatus according to claim 1 as the heating section.

25. An image forming apparatus comprising a fixing section that fixes an unfixed image formed on a recording medium, wherein the image forming apparatus uses the fixing apparatus according to claim 24 as the fixing section.

* * * * *